US005653857A

United States Patent [19]

Getsy et al.

[11] Patent Number: 5,653,857

[45] Date of Patent: Aug. 5, 1997

[54] FILTER PRESS ELECTROLYZER ELECTRODE ASSEMBLY

[75] Inventors: Andy W. Getsy, Eastlake; Gregory J. Manning, Chardon; Robert B. Kubinski, Parma; Kevin B. Garland, Madison, all of Ohio

[73] Assignee: Oxteh Systems, Inc., Chardon, Ohio

[21] Appl. No.: 564,507

[22] Filed: Nov. 29, 1995

[51] Int. Cl.[6] ..... C25B 9/00; C25B 11/03; C25B 11/10

[52] U.S. Cl. ..... 204/242; 204/252; 204/279; 204/283; 204/284; 204/286; 204/288; 204/289; 204/290 R; 204/290 F; 204/292; 204/293; 204/296; 204/254; 204/267

[58] Field of Search ..... 204/242, 286, 204/288, 284, 289, 252, 279, 283, 290 R, 290 F, 292, 293, 296, 254, 267

[56] References Cited

U.S. PATENT DOCUMENTS

| | | | |
|---|---|---|---|
| 3,265,526 | 8/1966 | Beer | 117/50 |
| 3,390,072 | 6/1968 | Wiseman | 204/286 X |
| 3,632,498 | 1/1972 | Beer | 204/290 F |
| 3,711,385 | 1/1973 | Beer | 204/59 |
| 4,022,679 | 5/1977 | Koziol et al. | 204/286 |
| 4,211,628 | 7/1980 | Obata et al. | 204/252 |
| 4,244,802 | 1/1981 | Pohto et al. | 204/288 X |
| 4,341,604 | 7/1982 | deNora et al. | 204/98 |
| 4,343,689 | 8/1982 | deNora et al. | 204/253 |
| 4,389,289 | 6/1983 | deNora | 204/128 |
| 4,464,242 | 8/1984 | Boulton | 204/288 X |
| 4,528,084 | 7/1985 | Beer et al. | 204/290 F |
| 4,536,263 | 8/1985 | deNora et al. | 204/98 |
| 4,584,080 | 4/1986 | Staab et al. | 204/286 X |
| 4,592,822 | 6/1986 | deNora | 204/252 |
| 4,606,805 | 8/1986 | Bon | 204/296 |
| 4,617,101 | 10/1986 | Sato et al. | 204/252 |
| 4,726,891 | 2/1988 | Beaver et al. | 204/288 X |
| 4,738,763 | 4/1988 | Abrahamson et al. | 204/255 |
| 4,853,101 | 8/1989 | Hruska et al. | 204/296 |
| 4,923,582 | 5/1990 | Abrahamson et al. | 204/255 |
| 5,183,545 | 2/1993 | Branca et al. | 204/252 |
| 5,188,712 | 2/1993 | Dilmore et al. | 204/98 |
| 5,360,526 | 11/1994 | Arimoto et al. | 204/288 X |
| 5,372,692 | 12/1994 | Sakamoto et al. | 204/288 X |
| 5,454,925 | 10/1995 | Garland et al. | 204/286 X |

*Primary Examiner*—Donald R. Valentine
*Attorney, Agent, or Firm*—John J. Freer; David J. Skrabec

[57] ABSTRACT

A filter press electrolyzer, such as for use in a chlor-alkali cell, has electrode assemblies which include a pan-shaped structure. The pan members have a planar floor and an upright side around the peripheral edge of the floor. The upright side terminates upwardly in a rim. The pan members are elongate, thereby providing long, at least substantially parallel sides at long pan edges as well as short sides at the top and bottom of the pan. On the pan floor are a series of parallel, rigid stand-offs, which project upwardly from the floor. These hold electrodes away from the back of the pan. These electrodes are typically large, somewhat flexible and at least substantially planar members, usually made of metal mesh. The stand-offs can include principal stand-offs located at the central area of the pan, plus additional stand-offs, typically one each at the top and bottom of the pan. The principal cathode stand-offs in the pan of a cathode assembly align in an offset manner between the principal anode stand-offs in the pan of an adjacent anode assembly. The height of the principal stand-offs rises above the rim of the pan. In this manner, the flexible electrodes deflect between the cathode and anode stand-offs, and the flexing minimizes the distance between adjacent anode and cathode members.

60 Claims, 3 Drawing Sheets

FILTER PRESS ELECTROLYZER ELECTRODE ASSEMBLY

BACKGROUND OF THE INVENTION

1. Technical Field

This invention relates to a filter press electrolyzer electrode assembly. Each electrode of the assembly is of a type having a back pan with electrodes spaced apart from the back pan by stand-offs. The electrolyzer can be used for the electrolysis of an electrolyte to generate a product such as chlorine and caustic soda.

2. Description of the Prior Art

It has been known to electrolyze a bath such as of salt water by using bar electrodes which are equidistantly positioned in parallel at both sides of a separating membrane. Apparatus as depicted in U.S. Pat. No. 4,211,628 has such bar electrodes and the electrodes are rigidly affixed to stiffeners. The bar electrodes can be positioned opposite one another on both sides of the separating membrane, or they can be offset from one another so as to position the membrane between opposing bar electrodes in a zigzag manner. For the offsetting arrangement, this is taught to shorten the inter-electrode distance.

Where the electrode is a mesh, such as a valve metal mesh screen, the membrane may be sandwiched between an anode screen and a cathode screen. In the structure depicted in U.S. Pat. No. 4,343,689, electrical current may be applied to the electrode screens by rigid ribs. It is therein taught in the patent that the ribs for the anode structure should be offset from the ribs of the cathode structure to avoid pinching of the membrane between the ribs, which would cause possible rupture of the membrane. In addition to rigid ribs, the current conducting means might be resilient and, by being offsetting, will provide a resilient sinusoidal bending of the electrode mesh. Even where the ribs are replaced, as by a sheet bent in a corrugated manner, the bends of the sheet are offset as such bends are shown to provide substantially the same, almost point or edge, contact as provided by the ribs.

It has also been taught that the membrane may be fabricated to include matter beyond the basic membrane. The added matter can take the form of porous layers, which have no electrode activity, as has been disclosed in the U.S. Pat. No. 4,617,101. There can be disposed against such an augmented membrane a flexible electrode. Where opposing electrodes are in rod form, a form as has been discussed hereinabove, they may be offset.

In electrode assemblies for membrane cells where the electrolyzer is a filter press electrolyzer, such electrode assemblies can have mesh electrodes which are separated by stand-offs from a back pan. As disclosed in U.S. Pat. Nos. 4,738,763 and 4,923,582, these stand-offs for the electrode assemblies can be spring members. The spring members may include large flat contact areas with the electrodes. Moreover, the spring stand-off members from the anode compartment can oppose directly the spring members from the cathode compartment.

Where the stand-offs have the configuration of a channel member, they may have a large, flat upper member, which can be plate-like, in contact with the mesh electrode. Or, after repair, they may have large, flat upper surfaces in the nature of a mesh structure that are in contact with the mesh electrode. Such structures have been shown for example in U.S. Pat. No. 5,454,925. When the upper flat member is plate-like, it is known that this member can be perforate by providing a single or double line of small holes along the length of the plate. It would be desirable in these structures to provide for a more uniform mechanical and hydraulic pressure against the membrane. It would also be desirable to combine such pressure improvements with enhanced electrode assembly operating efficiencies as well as with reduced wear on the membrane face.

SUMMARY OF THE INVENTION

An electrode assembly having a back pan with electrodes spaced apart from the back pan by stand-offs has now been devised which increases the open area of the electrode. The arrangement of the stand-offs for the anodes and cathodes of a cell partially incorporates the concept of offsetting alignment. Where anodes or cathodes or both are in resilient form, e.g., expanded metal mesh form, the stand-off arrangement can provide for augmented pressure against the back pan, enhancing electrical contact. By deforming the anodes and cathodes, they push back through the stand-offs and back pan, e.g., providing pressure on current distributors positioned behind the back pan. By combining this stand-off realignment with a stand-off height which is above the upper rim of the back pan, there further results the advantages of a more uniform mechanical pressure against the separator. Therefore, hydraulic pressure, which may vary, is not solely depended upon for either pressure against the membrane or for electrical contact in the assembly. These improvements have been combined with reduced electrode assembly fabrication costs plus enhanced operating performance, such as obtained by lower operating voltage requirements.

In one aspect, the invention is directed to an electrolytic cell having an anode assembly and a cathode assembly, which anode assembly and cathode assembly each have an at least substantially planar floor member, with each floor member forming at least part of an elongate electrode pan, and with the improvement in the cell comprising:

(a) a plurality of elongate anode stand-off members situated parallel to, but apart from, one another and each secured to the anode floor member;

(b) a plurality of elongate cathode stand-off members situated parallel to the anode stand-off members as well as parallel to, but apart from, one another and situated in the cell in positions offsetting the positions of the anode stand-off members, with each cathode stand-off member being secured to the cathode planar floor member;

(c) at least one additional elongate anode stand-off member secured to the anode planar floor member at one end of the anode pan; and (d) at least one additional elongate cathode stand-off member, secured to the cathode floor member at an end of the cathode pan, and in a position opposing the additional anode stand-off member.

In another aspect, the invention is directed to an electrode assembly for an electrolytic cell wherein said assembly has an at least substantially planar floor member which terminates at its perimeter with an upright side member, the floor and side members together forming at least a part of an elongate electrode pan, with the elongate pan providing long parallel sides at the long edges of the pan as well as short top and bottom pan ends. The improvement in this assembly comprises an elongate stand-off member, Z-shaped in cross section, secured to said planar floor member and situated at the top end of the pan, but spaced apart from the upright side member. This stand-off member comprises a bottom flange projecting in a first direction, with such bottom flange extending along, and secured in face-to-face contact to the planar floor member, with an upright web member connected to such bottom flange, and a top flange connected to the web member, which top flange projects in a second direction opposite to the bottom flange.

In yet another aspect of the invention, there is provided an elongate planar strip member adapted for bending into a standoff member for use in a pan-shaped electrode assembly, which strip member comprises:

(a) an elongate central web member extending along the length of the strip member, the central web member having perforations, the perforations including enlarged oval perforations and reduced circular perforations;

(b) a first solid and elongate flange member secured along an elongate, common first edge to the central web member; and (c) a second, perforate and elongate flange member secured along an elongate, common second edge to the central web member, such second flange having perforations including small circular perforations intermingled with smaller circular perforations.

In a still further aspect, the invention is directed to an elongate planar strip member adapted for bending into a standoff member for use in a pan-shaped electrode assembly, which strip member comprises:

(a) an elongate central web member extending along the length of the strip member, such central web member having circular perforations;

(b) a first solid and elongate flange member secured along an elongate, common first edge to such central web member; and (c) a second, perforate and elongate flange member secured along an elongate, common second edge to such central web member, said second flange having smaller circular perforations.

The invention also pertains to the aforesaid strip members which are bent in the form of a channel, or bent in a form having an at least substantially Z-shape in cross-section. The electrode assembly can be present in a cell having a membrane or a diaphragm porous separator. The electrode can be compressively urged into direct contact with the membrane or diaphragm porous separator of the cell. The cell can be utilized for the electrolysis of a dissolved species contained in a bath and generate a product such as chlorine, caustic soda, potassium hydroxide, or sodium sulfate.

DESCRIPTION OF THE PREFERRED EMBODIMENTS

Figure 1:
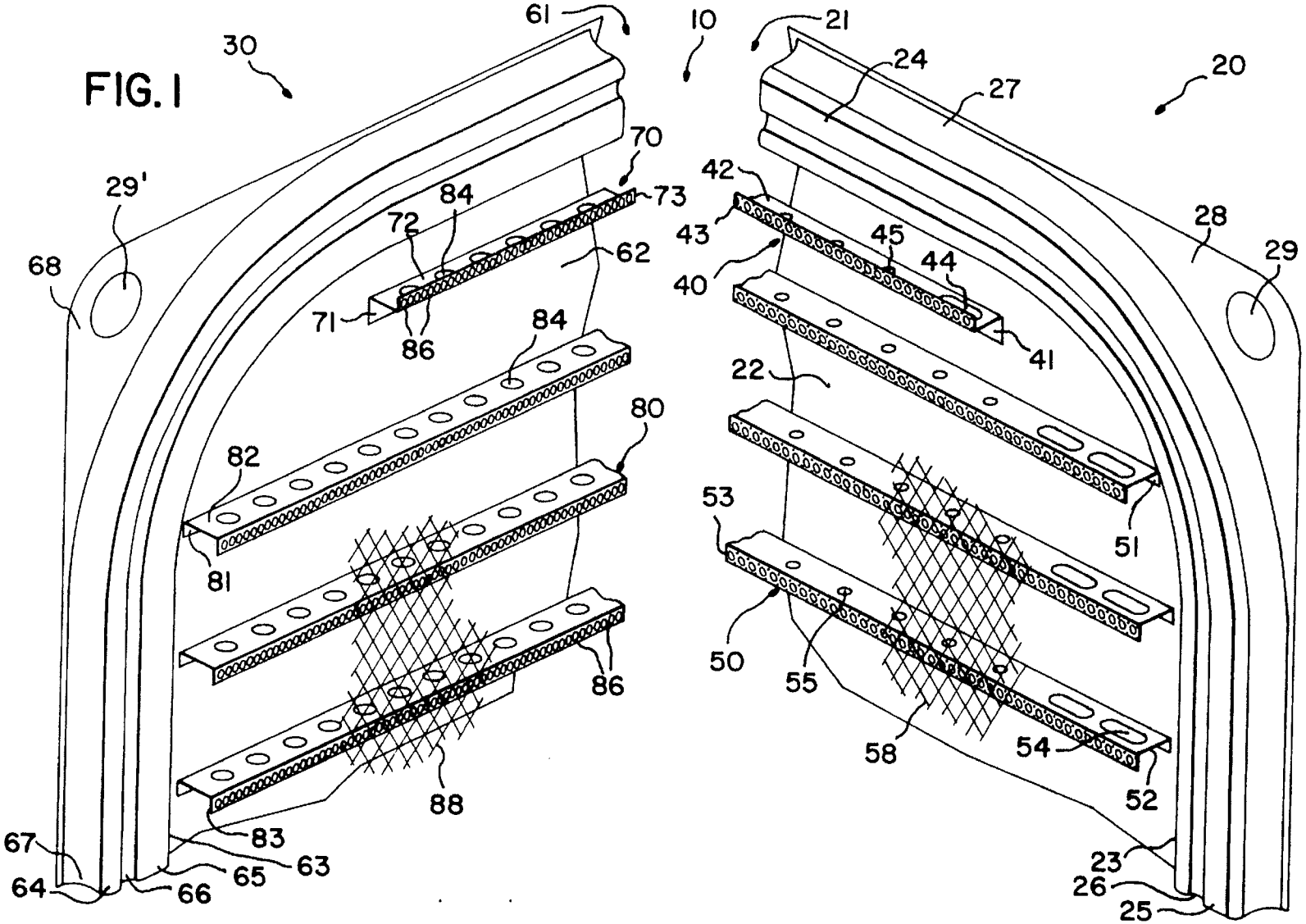
FIG. 1 is a cutaway perspective view of a pan-shaped cathode assembly and a pan-shaped anode assembly having some of the cathode stand-offs aligned half-way between some of the anode stand-offs.

The electrode assemblies of the present invention can be useful for the electrolysis of a dissolved species contained in a bath, such as in electrolyzers employed in a chlor-alkali cell to produce chlorine and caustic soda. The electrolyzers can also be useful to produce products such as potassium hydroxide or sulfuric acid, e.g., can be utilized for the splitting of salts, such as sodium chlorate and sodium sulfate, to regenerate acid and base values. Other uses include electrolytic destruction of organic pollutants, water electrolysis, electro-regeneration of catalytic intermediates, and electrolysis of sodium carbonate.

The metals of the anode assembly, including the anode stand-offs and the anode itself, will most always be valve metals, including titanium, tantalum, aluminum, zirconium and niobium. Of particular interest for its ruggedness, corrosion resistance and availability is titanium. Various grades of titanium metal are available. Advantageously, the titanium used will be grade 1 or grade 2 unalloyed titanium. However, as well as unalloyed metal, the suitable metals of the anode assembly can include metal alloys and intermetallic mixtures, such as contain one or more valve metals. The metal anode of the assembly, for convenience, may sometimes be referred to herein as the "foraminous metal anode" or simply the "anode". This anode will usually take the form of an expanded metal mesh, woven wire, blade grid, or punched and pierced louvered sheet. A representative expanded metal mesh is discussed further on hereinbelow in connection with the discussion of the cathode.

The metal cathode assembly can include the cathode stand-offs and the cathode itself. This cathode itself is sometimes referred to herein as the "foraminous metal cathode" or simply the "cathode". The cathode and cathode assembly elements can be made of any electrically conductive metal resistant to attack by the catholyte in the cell. Nickel is preferred, but steel and stainless steel can be advantageously used and valve metals such as titanium may be utilized. The active electrode surface area of the cathodes and anodes utilized with the assemblies of the present invention may comprise a foraminous surface of a type which is generally known in the art. The active surface can be uncoated, e.g., a bare, smooth nickel metal cathode. Alternatively, the active surface such as for the anodes can comprise a coated metal surface, such as a valve metal substrate having an electrocatalytic coating applied thereto. The coating can be a precious metal and/or oxides thereof, a transition metal oxide and mixtures of any of these materials as will be more particularly discussed further on hereinbelow. The active surface for the cathode might be a layer of, for example, nickel, molybdenum, or an oxide thereof which might be present together with cadmium. Other metal-based cathode layers can be provided by alloys such as nickel-molybdenum-vanadium and nickel-molybdenum. Such activated cathodes are well known and fully described in the art. Other metal cathodes can be in intermetallic mixture or alloy form, such as iron-nickel alloy, or alloys with cobalt, chromium or molybdenum, or the metal of the cathode may essentially comprise nickel, cobalt, molybdenum, vanadium or manganese.

For the cathode itself, a foraminous structure can be used. A preferred foraminous metal electrode is an expanded metal. By way of example, the expanded metal can be in typical electrode mesh form, with each diamond of mesh having an aperture of about one-sixteenth inch to one-quarter inch or more dimension for the short way of the design, while generally being about one-eighth to about one-half inch across for the long way of the design. These expanded mesh form cathodes can provide good current distribution and gas release. The cathode can, however, be a perforated plate, a blade grid, e.g., as shown in U.S. Pat. No.

4,022,679, or wire screening, or a punched and pierced louvered sheet. It is understood that this foraminous material has a high surface area which can have, for example, a large number of points of contact with a diaphragm separator, which may be brought about by having a large number of small perforations.

FIG. 1 depicts key elements for a representative electrode assembly of the present invention, but should not be construed as limiting the invention. Referring to FIG. 1, a filter press electrolyzer electrolytic cell 10 has an anode assembly 20 and a cathode assembly 30. Each assembly 20, 30 is shown in partial section. Typically, each section as shown in FIG. 1 can be considered to provide, for example, about one-quarter of a full electrode assembly. In the figure, the assemblies 20, 30 are shown opened, in a manner that a book is opened, and would be closed back on one another, in the manner of closing a book, in cell assembly. Referring then more particularly first to the anode assembly 20, this includes an elongate anode pan 21 that has long, at least substantially parallel sides, as well as shorter top and bottom ends. The pan 21 has a planar pan floor 22. This floor 22 terminates all around its perimeter in an upright, or vertical, pan side 23. The pan 21 thus includes the floor 22 and side 23. This pan side 23 extends upwardly into an outwardly flaring rim 24. This rim 24 has a horizontal flat surface 25 which is interrupted by a groove 26. The groove 26 permits insertion of a sealing member, not shown, at the rim 24. Outwardly from the pan floor 22, the rim 24 has an outer depending vertical edge 27 that terminates in an outer flat, horizontal pan surface 28. This outer flat pan surface 28 has an aperture 29 at each corner of the pan 21 which can be used, for example, with the rods (not shown) for aligning electrode assemblies during cell assembly. As used herein, "horizontal" and "vertical" are terms of convenience. They are employed to clarify the orientation of related parts. The use of these terms should not be construed as limiting the invention, e.g., they should not be construed as limiting the placement of the anode assembly, to any particular orientation, although typically the assembly is used in an upright manner, as when employed in an electrolyzer used for chlorine production. As noted hereinbefore, the anode pan 21 is most always a valve metal pan 21 such as of titanium, and including alloys and intermetallic mixtures, e.g., titanium alloyed with palladium, but might be a steel pan, such as of stainless steel.

Located on the pan floor 22, toward what is referred to herein for convenience as the top of the anode assembly 20, but spaced apart from the pan side 23, is at least one Z-shaped elongate rigid stand-off 40. As will be noted in the figure, this stand-off 40 is at least substantially Z-shaped in cross-section. When the term "Z-shaped" is used herein, it is used for convenience and is generally meant to refer to a stand-off in the shape of the stand-off 40 with an upright middle member, although it is to be understood that it is meant to include configurations such as where the cross-section of the stand-off could more explicitly have an actual Z shape or the like with a slanted middle member. In the representative electrode assembly, only one Z-shaped anode stand-off 40 occupies the space at the top of the anode pan 21. This Z-shaped stand-off 40 has a long, horizontal flange 41, also sometimes referred to herein as a "bottom" flange 41 or a "first" flange 41, secured to the pan floor 22. This bottom flange 41 is solid, i.e., non-perforate member. This Z-shaped stand-off 40 then has an upright, or upwardly extending (from the pan floor 22), vertical web member 42. The web member 42 and bottom flange 41 are secured together along a common elongate edge, sometimes referred to herein as a "first" edge, and which edge may be formed by bending a flat precursor strip (FIG. 3) into the configuration of the stand-off 40.

Figure 3:
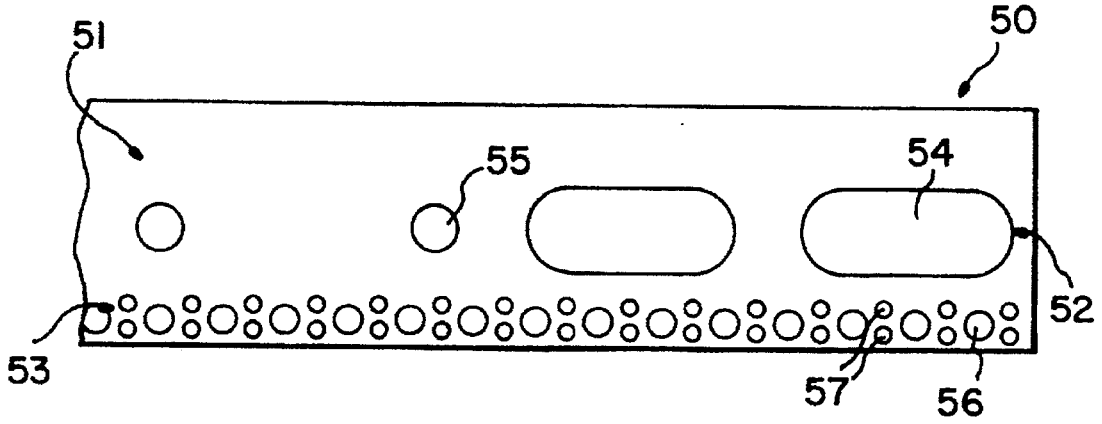
FIG. 3 is a front view of one embodiment of an anode stand-off for the anode assembly of FIG. 1, but in unbent, strip form.

The upright web member 42 then extends back horizontally in a top flange 43, sometimes referred to herein as a "second" flange 43. The web member 42 and top flange 43 are secured together by a common elongate edge sometimes termed a "second" edge. The bottom flange 41, web member 42 and top flange 43 may all extend the total length of said stand-off 40 in the manner as shown. However, other structure, e.g., a shortened bottom flange 41, is also contemplated. The upright, or vertical, web member 42 near its ends, has enlarged oval perforations 44. Between the enlarged oval perforations 44, the web member 42 has a series of reduced-size circular perforations 45. As shown in the figure, these reduced circular perforations 45 can be evenly spaced along the length of the web member 42 between its oval perforations 44. The top flange 43, from end to end, has a continuous sequence of circular perforations (FIG. 3). These include small circular perforations 56 positioned between sets of even smaller circular perforations 57 (FIG. 3). There can be two smaller perforations 57 per set and these can alternate along the length of the top flange 43 with the small circular perforations 56.

Spaced downwardly and apart from the Z-shaped anode stand-off 40 are a series, or multitude, of rigid, elongate C-shaped, or channel, anode stand-offs 50. When the term "C-shaped" is used herein, it is meant to refer to the channel shape of a stand-off. Such shape is preferred for stand-offs in this region of the pan floor 22 for convenience of fabrication access during manufacture of the anode assembly 20. These stand-offs 50 are at least substantially channel shaped, but for convenience are often referred to herein as C-shaped. Because of their great number, these stand-offs 50 may sometimes be referred to herein as the "principal" stand-offs 50. Conversely, the Z-shaped stand-offs 40 may be referred to for convenience as the "additional" stand-offs. The channel stand-offs 50 have a bottom, or "first", flange 51 secured to the pan floor 22. This bottom, horizontal flange 51 connects at a common first edge with a vertical web member 52 and the web member 52 connects through a common second edge with a top, or "second", flange 53. For this channel stand-off 50, the lower flange 51 is solid, i.e., unperforated. But the web member 52 has two enlarged oval-shaped perforations 54 near each end of the web member 52. Between these oval perforations 54 extending along the web member 52 are a series of reduced-size circular perforations 55. On the top flange 53 there extend along the length of the flange a series of circular perforation (FIG. 3). These include spaced, small perforations 56 between sets of even smaller circular perforations 57 (FIG. 3), with there being two perforations to a set. Each of the channel stand-offs 50 extend at least substantially along the full width of the pan floor 22, but are set apart at each end from contact with the pan side 23. This spacing between each end of the channel stand-off 50 and the pan side 23 can serve as a desirable electrolyte circulation space and to permit gasketing and sealing (not shown) around the pan side 23. Each channel stand-off 50 is not only spaced apart from the pan side 23, but the stand-offs 50 are spaced apart from one another. This spacing permits the anode stand-offs 50 to align between the cathode stand-offs 80.

Usually, the channel stand-offs 50 and Z-shaped stand-offs 40 for the anode assembly 20 will be of titanium, typically grade 1 or grade 2 titanium, or alloy or intermetallic mixture thereof, although other metals that have been discussed above as useful for the anode assembly may be utilized. Secured to the upper flanges 53 of the anode channel stand-offs 50 is a foraminous metal anode 58. This metal anode 58, which can be an expanded metal mesh anode 58, is secured to the anode channel stand-off upper flanges 53, but it is in unsecured contact with the Z-shaped anode stand-off upper flange 43.

The cathode assembly 30 in FIG. 1 has a cathode pan 61 that has a pan floor 62 which terminates at its perimeter in a pan side 63. The pan side 63 terminates outwardly in an outwardly flaring rim 64 which has an upper flat surface 65 interrupted by a groove 66. The groove 66 serves for the insertion of a sealing member, not shown. The flat surface 65 on the outwardly flaring rim 64, terminates outwardly in an outer edge 67 that depends downwardly and then extends further outwardly in an outer flat pan surface 68. This outer flat pan surface 68 has an aperture 29' that aligns in assembly with the aperture 29 of the anode pan surface 28 and provides positive location of the components during assembly. As noted above, the cathode pan 61 can be a metal pan of nickel or its alloys or intermetallic mixtures, or of other metal such as steel, including stainless steel.

On the pan floor 62, and spaced inwardly from the pan side 63, is a top Z-shaped cathode stand-off 70. As with the anode assembly 20, this cathode assembly 30 for the representative electrode assembly of this figure has only one Z-shaped cathode stand-off 70 at the top of the pan floor 62. This stand-off 70 has a bottom solid flange 71, an upright, perforate web member 72 and a perforate top flange 73. The perforate web member has large, circular perforations 84 and the perforate top flange 73 has small circular perforations 86 (FIG. 4) The extending of the top flange 73 toward the pan side 63 serves to enhance the support of a foraminous metal cathode 88 in the region of the pan 61 near the pan side 63.

Spaced further inwardly from the pan side 63, as well as spaced apart from the top Z-shaped cathode stand-off 70, are a series of cathode channel stand-offs 80. These stand-offs 80 each have a solid bottom flange 81 secured to the pan floor 62 and a perforate, upright web member 82 extending upwardly from the lower flange 81 to a horizontally extending, perforate top flange 83. The web member 82 and top flange 83 have perforations 84, 86 in the manner of the Z-shaped stand-off 70. Secured to the upper surface of the top flanges 83 is the foraminous metal cathode 88. However, this cathode 88 is not secured to the top flange 73 of the Z-shaped stand-off 70. Generally, the metals used in the cathode stand-offs 70, 80 are the metals employed for the cathode pan 61.

Figure 2:
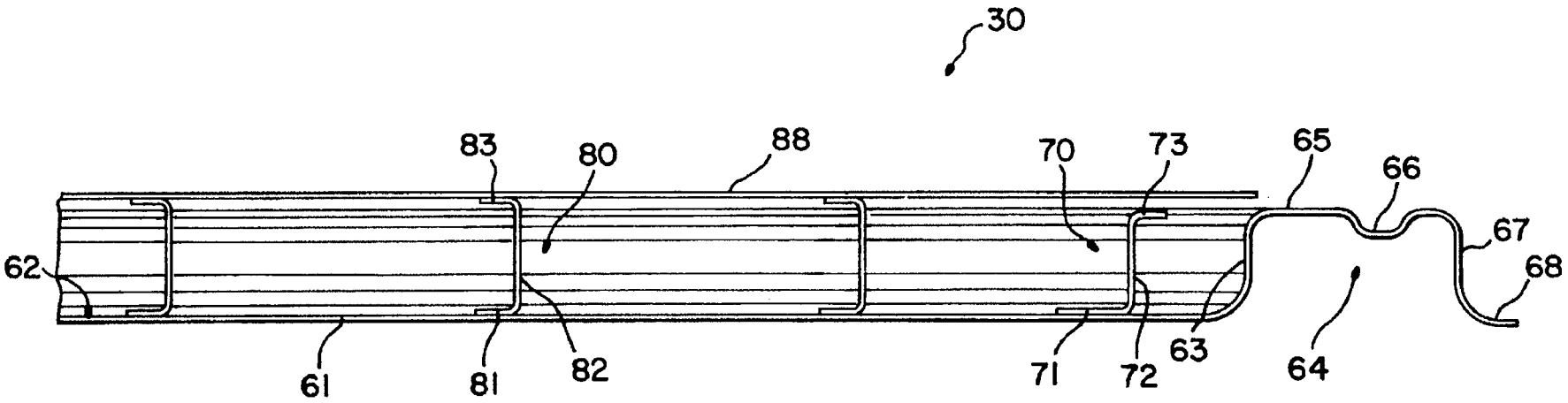
FIG. 2 is a sectional view of a portion of an electrode assembly of FIG. 1 showing an electrode affixed to some of the assembly stand-offs.

Referring then to FIG. 2, the cathode assembly 30 has a cathode pan 61 which has a pan floor 62 which terminates at its perimeter in a pan side 63. The pan side 63 terminates outwardly in an outwardly flaring rim 64 which has an upper flat surface 65 interrupted by a groove 66. The groove 66 serves for the insertion of a sealing member, not shown. The upper flat surface 65 on the outwardly flaring rim 64, terminates outwardly in an outer edge 67 that depends downwardly and then extends further outwardly in an outer flat pan surface 68.

On the pan floor 62 and spaced inwardly from the pan side 63 is a Z-shaped cathode stand-off 70. This stand-off 70 has a bottom flange 71, an upright web member 72 and a top flange 73. As for the Z-shaped anode stand-off 40, the cathode stand-off 70 extends upwardly from the pan floor 62 the height of the pan side 63, although it could extend to below the height of the pan side 63. Spaced further inwardly from the pan side 63, as well as spaced apart from the Z-shaped cathode stand-off 70, are a series of cathode channel stand-offs 80. These stand-offs 80 each have a bottom flange 81 secured to the pan floor 62 and an upright web member 82 extending upwardly from the bottom flange 81 to a horizontally extending top flange 83. These stand-offs 80 extend in height above the pan side 63. Secured to the upper surface of only the top flanges 83 is the foraminous metal cathode 88.

Referring then to FIG. 3, there is depicted a representative anode channel stand-off 50 as an elongate flat strip, i.e., in a form before bending to the configuration as depicted in FIG. 1. This representative elongate flat strip may typically have a ratio of length to width of on the order of 30:1. This anode channel stand-off strip 50 has a strip section for a bottom flange 51, a strip section for a web member 52 and a strip section for a top flange 53. For this stand-off strip 50 of the representative electrode assembly of the figures, the strip section 51 occupies about 20 percent of the distance across the width of the total strip 50. The top flange strip section 53 takes up a similar about 20 percent of total strip width. Thus, the about 60 percent balance of strip width is occupied by the web member 52. As depicted in FIG. 3, the strip section for the bottom flange 51 is a solid, i.e., an unperforated, member. The strip section for the web member 52 has enlarged, elongated oval perforations 54 near the end of this strip section 52. It is contemplated that there will be at least one oval perforation 54 at each end of this strip section 52, although there are usually more, e.g., the two perforations 54 as shown, or more. Also, one or more oval perforations 54 may be situated at the center of the strip section 52, as well as at each end.

Then, spaced inwardly from the end-positioned oval perforations 54, are a series of circular central perforations 55, reduced in size from the oval perforations 54. These circular perforations 55 are positioned in a line, i.e., aligned, along this central strip section 52. The strip section for the top flange 53, i.e., the lower strip section 53 as depicted in the figure, has a series of small, single circular edge perforations 56 in a line along the length of the strip 50. These small circular perforations 56 are interspersed and aligned between sets, with two to a set, of smaller circular perforations 57. All of these perforations 56, 57 along the edge extend along the length of the stand-off strip 50. The single edge perforations 56 are typically about 3 to about 5 times larger than the smaller perforations 57. Also, each central perforation 55 is generally 2 to 3 times larger than each single edge perforation 53.

As noted in FIG. 3, the oval perforations 54 are much larger than the circular central perforations 55 of the web member 52, and typically are about 4 to about 6 times larger. This large sizing of oval perforations 54 near the end of the stand-off strip 50 can serve to enhance electrolyte mixing. Away from the ends of the web member 52, the central perforations 55 can be used, rather than enlarged oval perforations 54, or away from the ends a blend of these perforations 54, 55 may be used, and be sufficient to permit gas to escape the electrode assembly when required in the electrolysis being conducted. Then the strip section 53 is a major perforate section. This provides some minor solid area for securing the foraminous metal anode 58 to the strip section 53, as by spot welding, while also providing many adjacent apertures in this strip section 53 adjacent the foraminous metal anode 58. This providing of a foraminous anode 58 against a section 53 of many perforations insures efficient electrolyte mixing and flow to a maximum surface of a separator (not shown) in contact with the anode 58. As will be understood, this representative stand-off of FIG. 3 may also serve to form the Z-shaped stand-off 40. For such purpose, the flat strip may have, for example, only one oval perforation 44 (FIG. 1) at each end of the stand-off 40.

Figure 4:
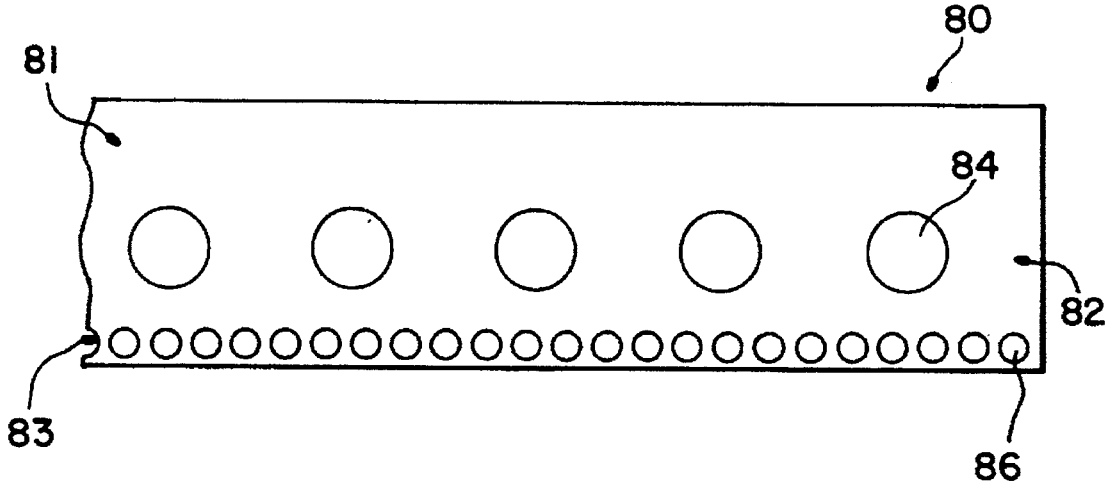
FIG. 4 is front view of one embodiment of a cathode stand-off, also in unbent, strip form, for the cathode assembly of FIG. 1.

Referring then to FIG. 4, there is depicted a representative cathode channel stand-off 80 as a flat strip, i.e., in a form before bending to the configuration as depicted in FIG. 1. As with the FIG. 3 anode stand-off, this flat strip of FIG. 4 may, in general, serve for providing the Z-shaped cathode stand-off 70, as well as the cathode channel stand-off 80. For purposes of convenience, the strip will, however, be described in relation to the channel stand-off 80. This cathode channel stand-off strip 80 has a strip section for a bottom flange 81, a strip section for a web member 82 (FIG. 1) and a strip section for a top flange 83. As for the anode channel stand-off strip 50 (FIG. 3), these strip sections 81, 82, 83 for a representative electrode assembly occupy about 20 percent, 60 percent and 20 percent, respectively, of the distance across the width of the stand-off strip 80. That is, the ratio of the height of the web member 82 to the width of the top flange 83 for this representative electrode assembly of the figures is about 2.5:1. As depicted in FIG. 4, the first strip section 81 is a solid, i.e., an unperforated, member. The strip section for the web member 82 has aligned large circular perforations 84. The strip section for the top flange 83 has a series of small circular perforations 86 uniformly aligned along the strip section 83.

As noted in FIG. 4, the large circular perforations 84 are much larger than the small circular perforations 86 of the top flange 83, and typically are about 7 to about 9 times larger. This large sizing of the circular perforations 84 along the strip 80 serves to enhance gas flow through the electrolyte in electrolysis operations generating gas. The large circular perforations 84 can be placed along the entire strip section for the web member 82, while nevertheless maintaining serviceable strength for this member 82. Then the strip section 83 for the top flange has circular perforations 86 which provide efficient electrolyte flow combined with a desirable accommodation of gas release in gas generating operations. As noted in FIG. 4, the perforations 84, 86 have been sized the same for both the Z-shaped cathode stand-off 70 and cathode channel stand-off 80, but such need not be the case. However, the sizing as depicted in the figures is preferred for economy.

As seen in FIGS. 2 and 3, the perforations are all usually spaced evenly apart one from the other, but such need not be the case. Also, although they are shown to be in alignment, it is contemplated that they need not always be so positioned. As noted in the figures, the perforations can be near an edge of the anode strip 50 or the cathode strip 80, but do not cut through the edge. This avoids "notching" of the edges. Notch-free edges can reduce, or eliminate, the possibility of sharp strip projections which may perforate the separator.

In fabrication of, for example, the anode assembly of FIG. 1, after forming of the anode pan 21, the Z-shaped anode stand-off 40 can be affixed to the pan floor 22. This stand-off 40 is typically secured to the pan floor 22 by welding the lower flange 41 to the pan floor 22. Next, the channel stand-offs 50 are affixed to the pan floor 22. These can also be secured to the floor 22 as by welding of the lower flanges 51 to the floor 22. During fabrication, channel stand-offs 50 are secured, top to bottom along the pan 21, in a spaced apart manner to permit the cathode channel stand-offs 80 to align between the anode channel stand-offs 50. However, the top Z-shaped cathode stand-off 70 may align directly opposite the top Z-shaped anode stand-off 40. In fabrication, the Z-shaped anode stand-off 40, and more particularly its top flange 43, is spaced apart from the top of the pan side 23 at the top of the anode pan 21. Similarly, the ends of this end stand-off 40 are spaced well inside the pan side 23. Also, both ends of each of the channel anode stand-offs 50 are spaced apart, during fabrication, from the pan side 23.

Following installation of all of the stand-offs 50 for the anode, or at the same time as the stand-offs 50 are installed, the foraminous metal anode 58 is secured to the upper flanges 53 of each of the channel stand-offs 50. This securing can be by welding, e.g., spot welding positioned at nodes of an expanded metal mesh anode 58 to portions of the solid metal on the upper flange 53. The anode 58 is left unsecured to the upper flange 43 of both the top Z-shaped stand-off 40 and the bottom Z-shaped anode stand-off (not shown).

Similar procedures as hereinabove described for fabrication of the anode assembly 20 are followed for manufacture of the cathode assembly 30. Thus, for example, the cathode channel stand-offs 80 are secured, such as by welding at the lower flanges 81, to the cathode pan floor 62. Similarly, at this time, the foraminous metal cathode 88 is secured to the upper flanges 83 of the cathode channel stand-offs 80. This can also be a securing by welding, such as spot welding of nodes of an expanded metal mesh cathode 88 to solid metal areas of the upper flanges 83. The cathode 88 is left unsecured to both the top Z-shaped cathode stand-off 70 and the bottom Z-shaped cathode stand-off (not shown). Where any lower flanges are to be secured to a pan floor, it is contemplated that such can be done not only by welding, e.g., resistance welding or TIG welding, but can also be done by other operations such as brazing, soldering or by mechanical means, including bolting.

In fabrication, both the metal cathodes 88 and anodes 58 extend over the full area, from top to bottom, of their respective pan floors 62, 22, in an offsetting manner as depicted in FIG. 1. Each cathode 88 and anode 58 also extends at least substantially across the width of its respective pan floor 62, 22, but comes short at each end of the pan side 23. The mesh cathode 88 and anode 58 may be fully sized toward the outer rim 24 of the pan, or they can be made smaller and be spaced apart from the outer rim 24. Also, it is advantageous for reducing possible separator damage that the mesh electrodes are a uniform single layer, i.e., not bent in a doubled over fashion, across their entire surface. For example, there is preferably no bending reinforcement of the meshes around their perimeter.

At this juncture of the fabrication, a sealing member can be inserted in the groove 26 of the anode pan 21. Similarly, a sealing member can be inserted in the groove 66 of the cathode pan 61. As will be noted by reference, for example, to FIG. 1, these sealing members do not align. Rather, the sealing member of the anode pan 21 aligns with a portion of the rim flat surface 65 of the cathode pan. Likewise, the sealing member of the cathode pan 61 aligns with the rim flat surface 25 of the anode pan 21. In this manner, a double seal is obtained along the rims 24, 64. Suitable materials for these sealing members can be EPDM (terpolymer elastomer of ethylene-propylene diene monomer), polytetrafluoroethylene, neoprene, or other elastomeric material.

Thereafter, a separator is placed typically on only one of the foraminous electrodes 58, 88. Then, the anode assembly 20 is brought into facing engagement with the cathode assembly 30, thereby sealing the rims 24, 64 with the sealing members located in the grooves 26, 66. Also, the anode 58 and cathode 88 are squeezed together, with a separator between, creating a zero gap. By the offset configuration of the anode and cathode channel stand-offs 50, 80, with separator between the anode 58 and cathode 88, the separator and electrodes 58, 88 are in "sandwich" form and are established in a flat, e.g., non-wrinkled, but slightly wavy configuration. This wavy feature of the electrode-and-separator sandwich compressively urges the electrodes 58, 88 into direct contact with the separator. It also exerts a force through the web members 42, 82 of the channel stand-offs 50, 80. This force is exerted through the pan floors 62, 22 to any member, e.g., a current distributor member, positioned on the backside of the pans 61, 21. Thus, the offset configuration of the channel stand-offs 50, 80 can enhance electrical current distribution to the electrolytic cell 10.

In fabrication, where the C-shaped stand-offs 50, 80 are initially in strip form (FIGS. 3 and 4), they are merely bent to conform to the C-shaped configuration for securing into their respective assemblies 20, 30. This bending of the channel stand-offs 50, 80 in strip form can be accomplished by any conventional metal bending technique, e.g., die forming, roll forming or stamping. Also, for providing the perforations in the stand-offs 50, 80, any means for perforating metal in strip form is contemplated as being useful. Usually, these perforations are provided by an operation such as die punching or pressing. Although the perforations are depicted in the figures as being provided in the stand-offs 50, 80 when in strip form, it will be understood that providing them when the stand-offs are other form, e.g., the bent form of FIG. 1, can be serviceable. Similar considerations for bending and perforating the Z-shaped stand-offs 40, 70 apply, as have been discussed hereinabove for the channel stand-offs 50, 80. Although the Z-shaped anode stand-off 40 is shown in FIG. 1 to have perforations, e.g., the oval perforations 44, sized the same as for the oval perforations 54 of the anode channel stand-offs, such continuity need not be the case. However, the uniformity as shown is preferred for economy.

Although the stand-offs 40, 70 have been discussed and shown as in a horizontal, linear positioning, it will be understood that other positioning may be employed. For example, a linear configuration for the stand-offs 40, 70 may be maintained, but they may be positioned in a vertical or diagonal manner to the orientation of the pans 21, 61. Also, for example, the linear configuration can be dispensed with, as where the stand-offs 40, 70 would be placed in a chevron pattern. The channel stand-offs 50, 80 can then align with such a diagonal or chevron pattern or the like. Also, although all of the channel stand-offs 50, 80 have been shown in the figures as facing in the same downward direction, such need not be the case. For example, the anode channel stand-offs 50 can be positioned in a reverse manner from that depicted so as to face upwardly and thus be positioned reverse to the cathode channel stand-offs 80. Or, individual stand-offs 50, 80 can be reversed, e.g., alternate anode stand-offs 50 can be reversed from the facing orientation depicted in FIG. 1, so long as an offsetting arrangement with the cathode stand-offs 80 is maintained.

Also, although the top Z-shaped anode stand-off 40 has a top flange 43 which points upwardly in FIG. 1, and thus toward the pan side 23, this overall positioning for the stand-off could be reversed. Generally, this top anode stand-off 40 is positioned as shown and the bottom Z-shaped anode stand-off (not shown) is positioned in the same way as shown for this top stand-off 40, i.e., with its top flange pointing upwardly. The positioning for the Z-shaped cathode stand-offs, i.e., the top stand-off 70 and bottom stand-off (not shown), may also be the same or reversed. Usually, the top stand-off 70 will be positioned as shown and the bottom stand-off will be situated so as to have its top flange pointing downwardly. Also, although the representative assembly of the figures utilizes one Z-shaped top anode stand-off 40 and one top cathode stand-off 70, the use of more than one of each such stand-offs 40, 70 at the top is contemplated. Similarly, more than one of each stand-off is contemplated for use at the bottom of the assembly. For all such stand-offs, it is preferred that they be positioned as opposing pairs of stand-offs 40, 70, whether at the top or the bottom of the assembly. With regard to the channel stand-offs, advantageously for economical cell fabrication operation, there will be one more anode channel stand-off 50 than cathode channel stand-off 80. Hence, the first channel stand-off at the top of the cell 10, as well as the last channel stand-off at the bottom of the cell 10, will advantageously be an anode stand-off 50. It is, however, to be understood that the cathode channel stand-offs 80 could predominate or that an equal number of anode and cathode stand-offs 50, 80 could be employed.

The advantageous configuration of a first and last anode stand-off 50, combined with the wavy feature of the electrode-and-separator sandwich, will provide that the sandwich flare against the Z-shaped cathode stand-off 70 at both the top and bottom of the cell 10. It will be understood that other configurations are, however, contemplated. Thus, the cathode channel stand-offs 80 could predominate and be the last top and bottom stand-offs. Thereby the sandwich could be influenced to flare against the Z-shaped anode stand-off 40 at both the top and bottom of the cell 10. Another serviceable configuration would be a last anode stand-off 50 at one end, and a last cathode stand-off 80 at the opposite end, with the sandwich flaring accordingly. Moreover, the Z-shape in cross-section for the stand-offs 40, 70 is for the representative electrode assembly of the figures. The Z-shape is preferred for these stand-offs 40, 70, but other configurations, e.g., channel shape, are contemplated. However, even in such other shape, these stand-offs 40, 70 oppose one another, i.e., are placed opposite one another and not offset from each other. Likewise, the channel configuration for the stand-offs 50, 80 is the preferred configuration, but other structures, e.g., I-shaped, are contemplated.

Following assembly, the electrolytic cell 10 can be incorporated into an electrolyzer, such as the filter press electrolyzer shown in U.S. Pat. No. 4,738,763. The disclosure of this patent is incorporated herein by reference. Thus the manifolding arrangement for the cell 10 to insure proper fluid flow and the like can be as described in this patent. Installation of such a cell 10 and its operation in a representative electrolyzer as described in the patent are well known by those skilled in the art.

Membranes suitable for use as separators in the cell 10 of the instant invention can readily be of types which are commercially available. One presently preferred material is a perfluorinated copolymer having pendant cation exchange functional groups. These perfluorocarbons are a copolymer of at least two monomers with one monomer being selected from a group including vinyl fluoride, hexafluoropropylene, vinylidine fluoride, trifluoroethylene, chlorotrifluoroethylene, perfluoro (alkyvinyl ether), tetrafluoroethylene, and mixtures thereof.

The second monomer often is selected from a group of monomers usually containing an $SO_2F$ or sulfonyl fluoride pendent group. Examples of such second monomers can be generically represented by the formula $CF_2{=}CFR_1SO_2F$. $R_1$ in the generic formula is a bi-functional perfluorinated radical comprising generally one to eight carbon atoms, but upon occasion as many as twenty-five. Examples of such perfluorocarbons generally are available commercially, such as through E. I. duPont, their products being known generally under the trademark NAFION. Perfluorocarbon copolymers containing perfluoro (3,6-dioxa-4-methyl-7-octenesulfonyl fluoride) comonomer have found particular acceptance.

It is also contemplated that the separator for the cell 10 can be a diaphragm, which may sometimes be referred to herein as a "diaphragm porous separator". For the diaphragm in the cell 10, a synthetic, electrolyte permeable diaphragm can be utilized. The synthetic diaphragms generally rely on a synthetic polymeric material, such as polyfluoroethylene fiber as disclosed in U.S. Pat. No. 5,606,805 or expanded polytetrafluoroethylene as disclosed in U.S. Pat. No. 5,183,545. Such synthetic diaphragms can contain a water insoluble inorganic particulate, e.g., silicon carbide, or zirconia, as disclosed in U.S. Pat. No. 5,188,712, or talc as taught in U.S. Pat. No. 4,606,805. Of particular interest for the diaphragm is the generally non-asbestos, synthetic fiber diaphragm containing inorganic particulates as disclosed in U.S. Pat. No. 4,853,101. The teachings of this patent are incorporated herein by reference.

Broadly, this diaphragm of particular interest comprises a non-isotropic fibrous mat wherein the fibers of the mat comprise 5–70 weight percent organic halocarbon polymer fiber in adherent combination with about 30–95 weight percent of finely divided inorganic particulates impacted into the fiber during fiber formation. The diaphragm has a weight per unit of surface area of between about 3 to about 12 kilograms per square meter. Preferably, the diaphragm has a weight in the range of about 3–7 kilograms per square meter. A particularly preferred particulate is zirconia. Other metal oxides, i.e., titania, can be used, as well as silicates, such as magnesium silicate and alumino-silicate, aluminates, ceramics, cermets, carbon, and mixtures thereof. Especially for this diaphragm of particular interest, the diaphragm may be compressed, e.g., at a compression of from about one to about 6 tons per square inch.

As representative of the electrochemically active coatings that have been mentioned hereinbefore such as for the foraminous metal anode 58 are those provided from platinum or other platinum group metals or they can be represented by active oxide coatings such as platinum group metals, magnetite, ferrite, cobalt spinel or mixed metal oxide coatings. Such coatings have typically been developed for use as anode coatings in the industrial electrochemical industry. They may be water based or solvent based, e.g., using alcohol solvent. Suitable coatings of this type have been generally described in one or more of the U.S. Pat. Nos. 3,265,526, 3,632,498, 3,711,385 and 4,528,084. The mixed metal oxide coatings can often include at least one oxide of a valve metal with an oxide of a platinum group metal including platinum, palladium, rhodium, iridium and ruthenium or mixtures of themselves and with other metals. Further coatings include tin oxide, manganese dioxide, lead dioxide, cobalt oxide, ferric oxide, platinate coatings such as $M_xPT_3O_4$ where M is an alkali metal and x is typically targeted at approximately 0.5, nickel-nickel oxide and a mixture of nickel and lanthanum oxides, such as lanthanum nickelate.

We claim:

1. In an electrolytic cell having an anode assembly and a cathode assembly, which anode assembly and cathode assembly each have an at least substantially planar floor member, which floor members each terminate at their perimeters at an upright side member, the side members with each floor member forming at least part of an elongate electrode pan, the improvement in said cell comprising:

(a) a plurality of elongate anode stand-off members situated parallel to, but apart from, one another and each secured to said anode floor member;

(b) a plurality of elongate cathode stand-off members situated parallel to said anode stand-off members as well as parallel to, but apart from, one another and situated in said cell in positions offsetting the positions of said anode stand-off members, with each cathode stand-off member being secured to said cathode planar floor member;

(c) at least one additional elongate anode stand-off member, which additional stand-off member is Z-shaped in cross-section and is secured to said anode planar floor member, by a bottom flange, at one end of the anode pan and spaced apart from said upright side member; and (d) at least one additional elongate cathode stand-off member, which additional stand-off member is Z-shaped in cross-section and is secured to said cathode floor member, by a bottom flange, at an end of the cathode pan and spaced apart from said upright side member, and in a position opposing said additional anode stand-off member.

2. The cell of claim 1 wherein said elongate anode and cathode pans each provide long parallel sides at long edges of the pan as well as shorter top and bottom pan ends.

3. The cell of claim 2 wherein said anode and cathode stand-off members include additional stand-off members positioned at each of said top and bottom pan ends, and a multitude of elongate channel stand-off members positioned between said top and bottom additional stand-off members.

4. The cell of claim 3 wherein the height of said channel stand-off members extends above the height of said upright side member, and the height of said Z-shaped additional stand-off members extends to or below the height of said upright side member.

5. The cell of claim 3 wherein said channel stand-off members comprise a bottom flange projecting in one direction and extending along said planar floor member and secured in face-to-face contact with said planar floor member, an upright web member connected to said bottom flange, and a top flange connected to said web member, which top flange projects in the same direction as said bottom flange.

6. The cell of claim 3 wherein said Z-shaped stand-off members and said channel stand-off members all have top flanges, and the top flanges for at least said channel stand-off members abut against a foraminous metal electrode member.

7. The cell of claim 6 wherein the channel stand-off member top flanges are secured to said electrode member and said Z-shaped stand-off member top flanges are unsecured to said electrode member.

8. The cell of claim 6 wherein said electrode member is compressively urged into direct contact with a membrane or diaphragm porous separator of said cell.

9. The cell of claim 8 wherein said cell having said membrane or diaphragm produces one or more of chlorine, caustic soda, potassium hydroxide or sulfuric acid.

10. The cell of claim 9 wherein said diaphragm is a synthetic diaphragm comprising organic polymer fibers in adherent combination with inorganic particulates.

11. The cell of claim 9 wherein said diaphragm comprises a non-isotropic fibrous mat comprising 5–70 weight percent of halocarbon polymer fiber in adherent combination with about 30–95 weight percent of finely divided inorganic particulates.

12. The cell of claim 6 wherein said electrode member is a cathode and said electrode member is one or more of an expanded metal mesh, woven wire, blade grid, or perforated plate member, and said electrode member is a metal member of one or more of nickel or alloys or intermetallic mixtures thereof, or steel including stainless steel.

13. The cell of claim 6 wherein said electrode member is an anode and said electrode member is an expanded metal mesh, woven wire, blade grid, or punched and pierced louvered sheet, and said electrode member is a metal member of one or more of titanium, niobium, or tantalum, or alloy or intermetallic mixture thereof.

14. The cell of claim 13 wherein said anode has an electrochemically active coating.

15. The cell of claim 14 wherein said electrochemically active coating contains a platinum group metal, or metal oxide or their mixtures.

16. The cell of claim 15 wherein said electrochemically active coating contains at least one oxide selected from the group consisting of platinum group metal oxides, magnetite, ferrite, cobalt oxide spinel, and tin oxide, and/or contains a mixed crystal material of at least one oxide of a valve metal and at least one oxide of a platinum group metal, and/or contains one or more of manganese dioxide, lead dioxide, platinate substituent, nickel-nickel oxide or a mixture of nickel and lanthanum oxides.

17. The cell of claim 1 wherein said anode pan is a metal pan of one or more of titanium, titanium alloyed with palladium, or other alloy, or intermetallic mixture, of titanium, or a metal pan of steel including stainless steel, or a metal pan of a valve metal other than titanium.

18. The cell of claim 1 wherein said cathode pan is a metal pan of one or more of nickel, or alloys or intermetallic mixtures thereof, or steel including stainless steel.

19. The cell of claim 1 wherein said members for said anode assembly are metal members of one or more of titanium, or alloy or intermetallic mixture of titanium, including grade 1 titanium and grade 2 titanium, and said stand-off members for said cathode assembly are metal members of one or more of nickel or steel, including stainless steel.

20. The cell of claim 1 wherein there is one more of said anode stand-off members than of said cathode stand-off members.

21. The cell of claim 1 wherein said stand-off members all have a solid bottom flange which is secured to said planar floor member by welding, including resistance welding or TIG welding, or are secured to said floor member by brazing, soldering, or by mechanical means including bolting.

22. In an electrode assembly for an electrolytic cell wherein said assembly has an at least substantially planar floor member which terminates at its perimeter with an upright side member, the floor and side members together forming at least a part of an elongate electrode pan, with the said elongate pan providing long parallel sides at the long edges of the pan as well as shorter top and bottom pan ends, the improvement in said assembly comprising an elongate stand-off member, Z-shaped in cross-section, secured to said planar floor member and situated at the top end of said pan but spaced apart from said upright side member, said stand-off member comprising a bottom flange projecting in a first direction with said bottom flange extending along, and secured in face-to-face contact to, said planar floor member, an upright web member connected to said bottom flange and a top flange connected to said web member, which top flange projects in a second direction opposite to said bottom flange.

23. The assembly of claim 22 further including a second elongate stand-off member, Z-shaped in cross-section, secured by a bottom flange to said floor member and positioned at the bottom end of said pan, but spaced apart from, said upright side member of said assembly.

24. The assembly of claim 23 wherein said assembly includes a multitude of elongate channel stand-off members positioned parallel to each other and spaced between, but apart from, said top and bottom Z-shaped support members, with said channel stand-off members being spaced apart one from the other.

25. The assembly of claim 24 wherein the height of said channel stand-off members extends above the height of said upright side member, and the height of said Z-shaped stand-off members extends below the height of said upright side member.

26. The assembly of claim 24 wherein said electrode is an anode and said Z-shaped stand-off members and said channel stand-off members are metal members of one or more of titanium, or alloy or intermetallic mixture of titanium, including grade 1 titanium and grade 2 titanium.

27. The assembly of claim 26 wherein said Z-shaped stand-off members have a solid bottom flange which is secured to said planar floor member by welding, including resistance welding or TIG welding, or are secured to said floor member by brazing, soldering, or mechanical means including bolting.

28. The assembly of claim 24 wherein said electrode is a cathode and said Z-shaped stand-off members and said channel stand-off members are metal members of one or more of nickel or steel, including stainless steel.

29. The assembly of claim 23 wherein said top end Z-shaped stand-off member has a top flange projecting towards an adjacent upright side member and said bottom end Z-shaped stand-off member has a top flange projecting away from an adjacent upright side member.

30. The assembly of claim 22 wherein said upright side member terminates at its top in a rim flaring outwardly away from said floor member, said rim is in a plane essentially parallel to the plane of said floor member, and said rim has a groove with a sealing member positioned within said groove.

31. The assembly of claim 30 wherein said sealing member is a gasket of EPDM, polytetrafluoroethylene, neoprene or other elastomeric material.

32. The assembly of claim 22 wherein said electrode is an anode and said pan is a metal pan of one or more of titanium, titanium alloyed with palladium, or other alloy, or intermetallic mixture, of titanium, or a metal pan of steel including stainless steel, or a metal pan of a valve metal other than titanium.

33. The assembly of claim 22 wherein said electrode is a cathode and said pan is a metal pan of one or more of nickel, or alloys or intermetallic mixtures thereof, or steel including stainless steel.

34. The assembly of claim 22 wherein said Z-shaped stand-off member has a solid bottom flange, a perforate web member and a perforate top flange.

35. The assembly of claim 34 wherein said perforate web member is notch-free and includes large oval perforations near each end of said web member, with the portion of the web member between the oval perforations having circular perforations sized smaller than said oval perforations.

36. The assembly of claim 34 wherein said top flange member is notch-free and includes circular perforations of a first size intermingled with a greater number of circular perforations of a second size which is smaller than said first perforations size.

37. The assembly of claim 22 wherein said Z-shaped support member has a ratio of the height of said upright web member to the width of said top flange of about 2.5:1.

38. The assembly of claim 22 wherein said top flanges of said Z-shaped stand-off members are positioned to contact a foraminous metal electrode member and are unsecured to said electrode member.

39. A cell for the electrolysis of a dissolved species contained in a bath of said cell and having an electrode assembly of claim 22.

40. An elongate planar strip member adapted for bending into a standoff member for use in a pan-shaped electrode assembly, which strip member comprises:

(a) an elongate central web member extending along the length of the strip member, said central member having perforations, said perforations including at least one enlarged oval perforation and at least one reduced circular perforations;

(b) a first, solid and elongate flange member secured along an elongate common first edge to said central web member; and (c) a second, perforate and elongate flange member secured along an elongate common second edge to said central web member, said second flange having perforations including small circular perforations intermingled with smaller circular perforations.

41. The strip member of claim 40 wherein each of said first flange member and said second flange member occupy about one-fifth of the distance across said strip member in the width direction.

42. The strip member of claim 40 wherein said elongate planar strip member has a ratio of length to width of about 30:1.

43. The strip member of claim 40 wherein said central web member has at least two oval perforations positioned near each end of said member and a series of said reduced circular perforations are spaced along said member between said oval perforations.

44. The strip member of claim 43 wherein the ratio of the total open area of each oval perforation to the total open area of each reduced circular perforation is within the range from about 4:1 to about 6:1.

45. The strip member of claim 40 wherein said smaller circular perforations are present as paired sets, and adjacent paired sets are spaced apart one from the other, with a small circular perforation positioned in said spacing.

46. The strip member of claim 45 wherein the ratio of the total open area of each small circular perforation in said perforate flange member to the total open area of each smaller circular perforation in said perforate flange member is within the range from about 3:1 to about 5:1.

47. The strip member of claim 40 wherein said strip is a metal member of titanium, niobium, or tantalum, or alloy or intermetallic mixture thereof, and said member is present in bent form in an anode assembly.

48. The strip member of claim 51 wherein said strip member is bent in the form of a channel.

49. The strip member of claim 47 wherein said strip member is bent in a form having an at least substantially Z-shaped in cross-section.

50. An elongate planar strip member adapted for bending into a standoff member for use in a pan-shaped electrode assembly, which strip member comprises:

(a) an elongate central web member extending along the length of the strip member, said central web member having circular perforations;

(b) a first, solid and elongate flange member secured along an elongate common first edge to said central web member; and (c) a second, perforate and elongate flange member secured along an elongate, common second edge to said central web member, said second flange having smaller circular perforations.

51. The strip member of claim 50 wherein each of said first flange member, and said second flange member occupy about one-fifth of the distance across said strip member in the width direction.

52. The strip member of claim 50 wherein said elongate planar strip member has a ratio of length to width of about 30:1.

53. The strip member of claim 50 wherein said central web member has said circular perforations spaced in a line along said web member and spaced equally apart, one from the other.

54. The strip member of claim 50 wherein the ratio of the total open area of each web member circular perforation to the total open area of each second flange circular perforation is within the range from about 7:1 to about 9:1.

55. The strip member of claim 50 wherein said strip is a metal member of one or more of titanium, niobium, tantalum or alloy or intermetallic mixture thereof, or steel including stainless steel, and said member is present in bent form in an anode assembly.

56. The strip member of claim 50 wherein said strip member is bent in the form of a channel, or bent in a form having an at least substantially Z-shape in cross-section.

57. An electrode assembly for an electrolytic cell, said assembly having:

(A) an at least substantially planar floor member which terminates at its perimeter with;

(B) an upright side member, the floor and side members together forming at least a part of;

(C) an elongate electrode pan, with the said elongate pan providing long parallel sides at the long edges of the pan as well as shorter top and bottom pan ends;

(D) a plurality of elongate stand-off members, situated parallel to, but apart from, one another, and each secured to said planar floor member, with each stand-off member comprising:

(a) a first, solid and elongate flange member secured in face-to-face contact with said planar floor member and secured along an elongate common first edge to;

(b) an elongate central web member extending along the length of the strip member, said central member having perforations, said perforations including enlarged oval perforations and reduced circular perforations; and (c) a second, perforate and elongate flange member secured along an elongate common second edge to said central web member, said second flange having perforations including small circular perforations intermingled with smaller circular perforations.

58. The assembly of claim 57 wherein each elongate stand-off member is spaced apart from said upright side member.

59. In an electrolytic cell having an anode assembly and a cathode assembly, which anode assembly and cathode assembly each have an at least substantially planar floor member, which floor members each terminate at their perimeters with an upright side member, and with each floor member forming at least part of an elongate electrode pan, the improvement in said cell comprising:

(a) a plurality of elongate anode stand-off members situated parallel to, but apart from, one another, and each secured to said anode floor member while extending in height above the height of said upright side member;

(b) a plurality of elongate cathode stand-off members situated parallel to, but apart from, one another and situated in said cell in positions offsetting the position of said anode stand-off members, with the height of each cathode stand-off member extending above the height of said upright side member;

(c) at least one additional elongate anode stand-off member, said additional anode stand-off member extending in height to or below the height of said upright side member; and (d) at least one additional elongate cathode stand-off member, in a position opposing said additional anode stand-off member, with said additional cathode stand-off member extending in height to or below the height of said upright side member.

60. In an electrolytic cell having an anode assembly and a cathode assembly, which anode assembly and cathode assembly each have an at least substantially planar floor member, with each floor member forming at least part of an elongate electrode pan, the cell having a plurality of elongate anode stand-off members situated parallel to, but apart from, one another and each secured to the anode floor member, a plurality of elongate cathode stand-off members situated parallel to said anode stand-off members as well as parallel to, but apart from, one another, with each cathode stand-off member being secured to the cathode floor member, said cell also comprising at least one additional elongate anode stand-off member secured to said anode planar floor member at one end thereof, and at least one additional elongate cathode stand-off member, secured to said cathode floor member at one end thereof, the improvement in said cell comprising:

(a) a plurality of principal cathode stand-off members situated in said cell in positions offsetting the positions of a plurality of principal anode stand-off members; and (b) an additional cathode stand-off member situated in said cell in a position opposing an additional anode stand-off member.

* * * * *

UNITED STATES PATENT AND TRADEMARK OFFICE

CERTIFICATE OF CORRECTION

PATENT NO. : 5,653,857

DATED : August 5, 1997

INVENTOR(S) : A. W. Getsy et al

It is certified that error appears in the above-identified patent and that said Letters Patent is hereby corrected as shown below:

Claim 48, column 17, first line, after "claim", change "51" to "47".

Signed and Sealed this

Twenty-third Day of December, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,653,857

DATED : August 5, 1997

INVENTOR(S) : A. W. Getsy et al

It is certified that error appears in the above-identified patent and that said Letters Patent is hereby corrected as shown below:

Title Page, Item (73), change the name of the Assignee from "Oxteh Systems, Inc." to "OxyTech Systems, Inc."

Claim 48, column 17, first line, after "claim", change "51" to "47".

Signed and Sealed this

Seventeenth Day of November, 1998

*Attest:*

*Attesting Officer*

BRUCE LEHMAN

*Commissioner of Patents and Trademarks*